US007346289B2

(12) United States Patent
Tamaoki

(10) Patent No.: US 7,346,289 B2
(45) Date of Patent: Mar. 18, 2008

(54) IMAGE FORMING APPARATUS

(75) Inventor: Tomohiro Tamaoki, Moriya (JP)

(73) Assignee: Canon Kabushiki Kaisha (JP)

( * ) Notice: Subject to any disclaimer, the term of this patent is extended or adjusted under 35 U.S.C. 154(b) by 189 days.

(21) Appl. No.: 11/404,594

(22) Filed: Apr. 14, 2006

(65) Prior Publication Data

US 2006/0233565 A1 Oct. 19, 2006

(30) Foreign Application Priority Data

Apr. 15, 2005 (JP) ..... 2005-118469

(51) Int. Cl.
*G03G 15/00* (2006.01)

(52) U.S. Cl. ..... 399/96; 399/44

(58) Field of Classification Search ..... 399/9, 399/44, 96, 97

See application file for complete search history.

(56) References Cited

U.S. PATENT DOCUMENTS 5,953,552 A * 9/1999 Someya ..... 399/13

FOREIGN PATENT DOCUMENTS

| | | | |
|---|---|---|---|
| JP | 5-119671 | A | 5/1993 |
| JP | 2000-259033 | A | 9/2000 |
| JP | 2003-28721 | A | 1/2003 |
| JP | 2003-195679 | A | 7/2003 |

* cited by examiner

*Primary Examiner*—Hoang Ngo
(74) *Attorney, Agent, or Firm*—Rossi, Kimms & McDowell, LLP

(57) ABSTRACT

An image forming apparatus that can maintain the accuracy of temperature control of an object to be heated within a predetermined range and avoid adverse effects of contamination of first temperature detection means. The image forming apparatus 1 has a photosensitive drum 14, a heater 901, a thermopile temperature sensor 902, a non-contact thermistor 903, and a control circuit 904. The control circuit 904 controls the heater 901 based on an output signal 902*s* in a case where the output signal 902*s* is output earlier in time than the output signal 903*s*, and informs of a state of the thermopile temperature sensor 902 in a case where the output signal 903*s* is output earlier in time than the output signal 902*s*.

12 Claims, 15 Drawing Sheets

IMAGE FORMING APPARATUS

BACKGROUND OF THE INVENTION

1. Field of the Invention

The present invention relates to an image forming apparatus that detects and controls the temperature of an object being heated by heating means. For example, it relates to an image forming apparatus that performs temperature control of a photosensitive member and a fixing unit.

2. Description of the Related Art

A typical image forming apparatus, such as a copier and a printer, uses a laser beam to form an electrostatic latent image on a photosensitive drum, which is an electrostatic latent image carrier. Such an apparatus makes the surface of the photosensitive drum electrified using an electrostatic charger and then sequentially performs exposure, development, transfer and fixing, thereby forming an image on a sheet of paper.

It is known that, in such an image forming apparatus, an ozone product is deposited on the surface of the photosensitive drum, and particularly in a high-humidity environment, an image deletion (a phenomenon that an image is blurred) occurs. In the case of a photosensitive drum that is relatively susceptible to wear, such as made of an organic photosensitive compound (OPC), the ozone product or the like can be relatively easily removed by polishing using abrasive means or the like. However, if the effect of the polishing is excessively high, the functionality of the photosensitive drum is deteriorated, and the service life thereof is shortened. On the other hand, there exists a photosensitive drum having the ozone product or the like deposited thereon which is hard to remove because of its high hardness, such as an amorphous silicon photosensitive drum.

Thus, in an electrophotographic image forming apparatus, a photosensitive drum heater is disposed in or near the photosensitive drum to control the surface temperature of the photosensitive drum approximately within a range of 35 to 45 degrees Celsius. While the temperature control of the photosensitive drum is carried out for various purposes, a primary purpose is to prevent or remove an image deletion occurring in a high-humidity environment. Ozone generated in a corona charger chemically modifies the surface of the photosensitive drum, and therefore, a hydrophilic group or the like is formed on the drum surface to provide the surface of the photosensitive drum with hygroscopicity. This causes an electrophotographic problem of a lateral shift of the surface potential of the photosensitive drum. Thus, the temperature of the photosensitive drum is controlled to remove the moisture on the surface that causes the problem. In addition, a material generated from ozone, such as NOx, is deposited on the surface of the photosensitive drum to provide the drum surface with hygroscopicity. Thus, the temperature control is carried out also to remove the moisture. In this way, an image deletion occurring in a high-humidity environment is prevented.

FIG. 13 is a diagram for illustrating temperature control of a photosensitive drum according to prior-art example 1.

In the example shown in FIG. 13, a photosensitive drum 2004 incorporates a heater 2001 that serves as a heating source, a thermistor 2002 that serves as temperature detection means, and a heater driver 2003 that controls the heater 2001 based on the output of the thermistor 2002. Reference numeral 2005 designates an AC power supply. Temperature control of the photosensitive drum 2004 is performed by detecting the temperature of the heater 2001 by the thermistor 2002 disposed in the heater 2001, rather than by detecting the surface temperature of the photosensitive drum.

FIG. 14 is a diagram for illustrating temperature control of a photosensitive drum according to prior-art example 2.

In the example shown in FIG. 14, a heater 3001 is disposed in a photosensitive drum 3002, and a non-contact thermistor 3003 is disposed close to the surface of the photosensitive drum 3002. Reference numeral 3005 designates an AC power supply. Temperature control of the photosensitive drum 3002 is performed by detecting the convection heat on the surface of the photosensitive drum 3002 by means of the thermistor 3003 and by controlling the heater 3001 by means of a heater driver 3004 disposed outside the photosensitive drum 3002.

This temperature control method has an advantage that the heating source can be controlled while detecting the surface temperature of the photosensitive drum to thereby detect any variation of the surface temperature of the photosensitive drum occurring in the course of operation of the image forming apparatus. However, in this temperature control method, a thermistor as temperature detection means is disposed out of contact with the surface of the photosensitive drum and detects the convection heat, rather than disposed in contact with the surface of the photosensitive drum, in order to prevent the thermistor from scratching the surface of the photosensitive drum. Consequently, the temperature detection accuracy is hard to improve because in addition to the fact that the performance of the thermistor itself is hard to improve, the detected temperature value is affected by the distance between the thermistor and the surface of the photosensitive drum. In addition, there is a problem of large temperature ripple because the response of the temperature detection is slow due to the heat capacity of the thermistor itself.

Thus, there has recently been contemplated that infrared temperature detection means is used which detects the amount of infrared radiation emitted from the surface of a temperature detection object to detect the temperature of the detection object. A representative one of such infrared sensors is a thermopile temperature sensor shown in FIG. 15.

FIG. 15 is a diagram showing an arrangement of a thermopile temperature sensor.

Referring to FIG. 15, a thermopile temperature sensor 4001 has a thermopile element 4002 comprising multiple thermocouples made of two different kinds of metals or semiconductor materials and connected in series to each other. A cold junction of the thermopile element 4002 is disposed in a heat sink 4003 that has a high heat capacity and provides for a reference, and a hot junction of the thermopile element 4002 is fixed to a member having a low heat capacity, and the thermopile element 4002 is covered with an infrared absorbing member 4004.

The infrared radiation emitted from the surface of the temperature detection object is collected through a lens 4005 of the thermopile temperature sensor 4001 and absorbed in the infrared absorbing member 4004. Alternatively, the infrared radiation from the object surface passes through a filter (not shown) disposed instead of the lens, and only part of the infrared radiation of a particular wavelength is absorbed in the infrared absorbing member 4004. Then, the thermopile element 4002 outputs a signal Sa corresponding to the temperature difference between the cold junction and the hot junction. Besides, a thermistor 4006 disposed at the cold junction detects the absolute temperature of the cold junction and outputs a signal Sb indicating the detected temperature. The signals Sa and Sb are input to a calculation circuit 4007, which produces a signal Sc that indicates the absolute surface temperature of the temperature detection object.

During manufacture of the thermopile temperature sensor 4001, the thermopile element 4002 and the thermistor 4006 are combined with the calculation circuit 4007, and they are adjusted so that the required detection accuracy can be achieved in a temperature zone where the sensor is actually used for the temperature detection. Thus, compared with the thermistor sensors shown in FIGS. 13 and 14, the temperature detection accuracy can be improved because the absolute surface temperature of the temperature detection object is detected.

Since such a thermopile temperature sensor has a high temperature detection accuracy, if the thermopile temperature sensor is used to detect the surface temperature of the photosensitive drum, there is a large latitude for an image deletion caused by a drop of the surface temperature of the photosensitive drum or for a failure due to melting/hardening of toner caused by a rise of the surface temperature of the photosensitive drum. Thus, the surface temperature of the photosensitive drum can be made more stable, and the image stability can be improved. In addition, the thermopile temperature sensor 4001 has an advantage that the response is quick compared with the non-contact thermistor, since the thermopile temperature sensor 4001 has a microstructure that enables rapid temperature detection.

Furthermore, in Japanese Laid-Open Patent Publication (Kokai) No. 2003-028721, there is proposed a method of improving the temperature detection accuracy in which a thermopile temperature sensor is used for a fixing unit. Furthermore, in Japanese Laid-Open Patent Publication (Kokai) No. 2000-259033, an image forming apparatus is proposed, in which a deviation error in temperature detection by a thermopile temperature sensor is corrected. That is, a contact thermistor with a contact/separation mechanism is provided for correction of the deviation error in temperature detection. The contact/separation mechanism keeps the thermistor separated from the fixing unit during normal operation and brings the thermistor into contact with the fixing unit when determining the deviation error in temperature detection, such as at the time of power-on.

However, even when the thermopile temperature sensor having a high temperature detection accuracy is used, if the required maintenance including lens cleaning is not adequately performed, the lens is soiled with paper dust or toner, the amount of infrared radiation passing through the lens decreases, and the detected temperature is shifted to lower temperatures. For example, when the thermopile temperature sensor is used for detecting the surface temperature of the photosensitive drum, if the temperature control is continued after the detected temperature is shifted to lower temperatures, the actual temperature of the photosensitive drum is higher than the detected temperature. As a result, toner can be molten and hardened on the developing sleeve that is in contact with the photosensitive drum, or the image stability can be deteriorated because the surface potential of the photosensitive drum varies due to the variation of the surface temperature of the photosensitive drum.

The technique disclosed in Japanese Laid-Open Patent Publication (Kokai) No. 2000-259033, which is designed to improve the accuracy of reference temperature (absolute temperature) detection by using a plurality of thermistors in addition to the thermopile element, is not effective against the problem of the shift of the detected temperature due to contamination of the lens. Thus, it is necessary for example to correct the temperature measured by the non-contact temperature sensor using the correcting temperature sensor.

The technique disclosed in Japanese Laid-Open Patent Publication (Kokai) No. 2000-259033 requires the contact/separation mechanism for the contact thermistor and, thus, has a problem concerning the installation space and cost of the contact/separation mechanism.

Furthermore, there has been developed an image forming apparatus that uses a thermopile temperature sensor for controlling the temperature of a fixing unit and has a cleaning member for cleaning the lens of the thermopile temperature sensor and an actuator that drives the cleaning member. This technique solves the problem of contamination of the lens of the thermopile temperature sensor but has a problem concerning the installation space and cost of the cleaning member, the actuator and the like.

SUMMARY OF THE INVENTION

The present invention has been devised to solve the problems with the prior art.

It is an object of the present invention to provide an image forming apparatus that can maintain the accuracy of temperature control of an object to be heated within a predetermined range and avoid adverse effects of contamination of first temperature detection means.

To attain the above object, in a first aspect of the present invention, there is provided an image forming apparatus comprising an image carrier that is rotationally driven, a heating device that heats the image carrier, a first temperature detection device that is disposed out of contact with a surface of the image carrier to detect temperature of the image carrier, a second temperature detection device that is disposed out of contact with the surface of the image carrier to detect the temperature of the image carrier, and a control device that controls the heating device based on a first surface temperature detection signal for the image carrier indicating a detection result of the first temperature detection device and a second surface temperature detection signal for the image carrier indicating a detection result of the second temperature detection device, wherein the control device controls the heating device based on the first surface temperature detection signal in a case where the first surface temperature detection signal is output earlier in time than the second surface temperature detection signal, and informs of a state of the first temperature detection device in a case where the second surface temperature detection signal is output earlier in time than the first surface temperature detection signal.

Preferably, in the case where the second surface temperature detection signal is output earlier in time than the first surface temperature detection signal, the control device informs of the state of the first temperature detection device and stops heating after a lapse of a predetermined time period.

Preferably, in the case where the second surface temperature detection signal is output earlier in time than the first surface temperature detection signal, the control device informs of the state of the first temperature detection device and stops heating when a state where the second surface temperature detection signal is output earlier in time than the first surface temperature detection signal occurs a predetermined number of times.

Preferably, in the case where the second surface temperature detection signal is output earlier in time than the first surface temperature detection signal, the control device informs of the state of the first temperature detection device and performs changeover to control of the heating device based on the second surface temperature detection signal.

Preferably, a detection method of the first temperature detection device is selected from a group including a detection method that detects temperature of the image carrier based on an amount of infrared radiation collected by light collecting means and a detection method that detects the temperature of the image carrier based on an amount of infrared radiation filtered by a filter.

Preferably, the first temperature detection device is a thermopile temperature sensor that is disposed out of contact with the image carrier and has a thermopile element and at least one thermistor.

Preferably, the second temperature detection device is selected from a group including a non-contact thermistor disposed out of contact with the image carrier and a thermistor-based non-contact temperature sensor disposed out of contact with the image carrier.

To attain the above object, in a second aspect of the present invention, there is provided an image forming apparatus comprising an image carrier that has a heating device and is rotationally driven, a first temperature detection device that is disposed out of contact with a surface of the image carrier to detect temperature of the image carrier, a second temperature detection device that is disposed out of contact with the surface of the image carrier to detect the temperature of the image carrier, a correction section that corrects a first surface temperature detection signal based on a second surface temperature detection signal for the image carrier indicating a detection result of the second temperature detection device that is obtained when the heating device is controlled to a predetermined temperature based on the first surface temperature detection signal for the image carrier indicting a detection result of the first temperature detection device, and a control device that controls the heating device based on the first surface temperature detection signal corrected by the correction section.

Preferably, the correction section corrects the first surface temperature detection signal at predetermined time intervals or every a predetermined number of images formed.

Preferably, a detection method of the first temperature detection device is selected from a group including a detection method that detects the temperature of the image carrier based on an amount of infrared radiation collected by light collecting means and a detection method that detects the temperature of the image carrier based on an amount of infrared radiation filtered by a filter.

Preferably, the first temperature detection device is a thermopile temperature sensor that is disposed out of contact with the image carrier and has a thermopile element and at least one thermistor.

Preferably, the second temperature detection device is selected from a group including a non-contact thermistor disposed out of contact with the image carrier and a thermistor-based non-contact temperature sensor disposed out of contact with the image carrier.

According to the present invention, if detection information of or temperature detected by second temperature detection means exceeds a predetermined range, it is determined that an abnormality occurs in first temperature detection means, and an alert is issued. In addition, the detection information of the first temperature detection means is corrected based on the detection information of the second temperature detection means. In addition, if the detection information of the second temperature detection means exceeds a predetermined range, heating of an object to be heated is stopped. Thus, the accuracy of temperature control of the object to be heated can be maintained within a predetermined range, so that adverse effects of contamination of the first temperature detection means can be avoided.

The above and other objects, features, and advantages of the invention will become more apparent from the following detailed description taken in conjunction with the accompanying drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

The present invention will now be described in detail with reference to the accompanying drawings showing preferred embodiments thereof. The embodiments described below are not intended to limit the scope of the present invention, which is defined by the claims, and all the combinations of the features described with regard to the embodiments are not always essential to attain the object of the present invention.

First, a description will be given of a first embodiment of the present invention.

Figure 1A:
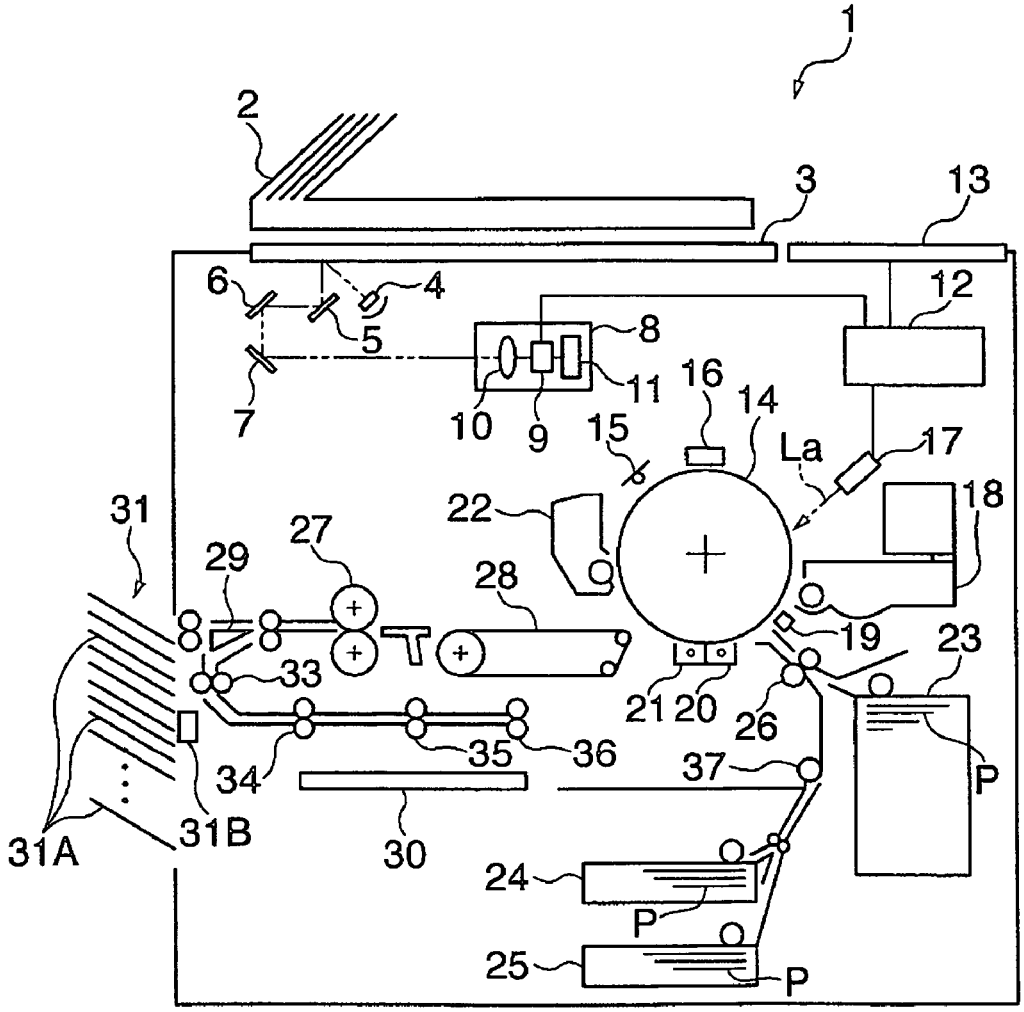
FIG. 1A is a view schematically showing the construction of an image forming apparatus according to a first embodiment of the present invention provided with a staple sorter.
Figure 1B:
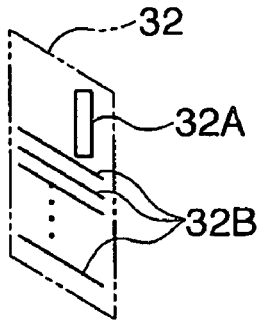
FIG. 1B is a view schematically showing the construction of the image forming apparatus according to the first embodiment of the present invention provided with a bookbinding machine.

FIG. 1A is a view schematically showing the construction of an image forming apparatus according to the first embodiment of the present invention provided with a staple sorter. FIG. 1B is a view schematically showing the construction of the image forming apparatus according to the first embodiment of the present invention provided with a bookbinding machine.

In FIG. 1, an image forming apparatus (copier) 1 has an automatic original feeding device 2, a CCD unit 8, a controller section 12, a photosensitive drum 14, a primary charger 16, a laser unit 17, a developing device 18, a transfer precharger 19, a transfer charger 20, a separating charger 21, a fixing unit 27, a staple sorter 31 (or a bookbinding machine 32), for example.

The automatic original feeding device 2 sequentially feeds originals to be read (not shown) to a predetermined position on an original platen glass 3 and ejects the originals having been read. An original illumination lamp 4, which may be a halogen lamp, scans image data on an original placed on the original platen glass 3 for exposure. Scanning mirrors 5, 6 and 7 guide a reflected light image from the original to the CCD unit 8. The original illumination lamp 4 and the scanning mirrors 5 to 7 are held by an optical scanning unit. The whole image data on the original is scanned by the original illumination lamp 4 and exposed to light by the optical scanning unit repeatedly reciprocating in a direction perpendicular to the sheet of the drawing and in a horizontal direction in the sheet of the drawing.

The CCD unit 8 has an image pickup device 9 constituted by a CCD or the like, an image forming lens 10 that forms the reflected light image guided by the scanning mirrors 5 to 7 onto the image pickup device 9, and a CCD driver 11 that drives the image pickup device 9. The CCD unit 8 converts the output signal from the image pickup device 9 depending on the reflected light image into 8-bit digital data, for example, and then inputs the digital data to the controller section 12.

The photosensitive drum 14 is an electrostatic latent image carrier in the form of a cylinder or a circular column. A pre-exposure lamp 15 eliminates electric charge on the outer periphery of the photosensitive drum 14 for the next image formation. The primary charger 16 electrifies the outer periphery of the photosensitive drum 14 to provide a predetermined potential distribution by corona charging for formation of an electrostatic latent image. The laser unit 17 has two semiconductor lasers as light sources and illuminates the outer periphery of the photosensitive drum 14 charged by the primary charger 16 for exposure according to the digital data input from the controller section 12, thereby forming an electrostatic latent image based on the supplied image data on the outer periphery of the photosensitive drum 14. The developing device 18 deposits toner on the electrostatic latent image formed on the outer periphery of the photosensitive drum 14 and develops the toner, thereby forming a developed image (a toner image).

The transfer precharger 19 applies a high voltage to the toner image on the outer periphery of the photosensitive drum 14 before transfer. The transfer charger 20 transfers the toner image onto a sheet of recording paper P by well-known corona discharge or the like. The separating charger 21 separates the sheet of recording paper P with the toner image transferred thereon from the outer periphery of the photosensitive drum 14. A cleaner 22 removes and collects the developer residue on the outer periphery of the photosensitive drum 14 after transfer is finished.

Now, a transfer operation will be briefly described. First, the transfer precharger 19 applies a high voltage to the toner image formed on the outer periphery of the photosensitive drum 14. Then, a sheet of recording paper P is conveyed from any one of paper feed units 23, 24 and 25, in which a plurality of recording sheets P e.g. of different sizes are retained, to a transfer region between the photosensitive drum 14 and the transfer charger 20, with a timing adjustment being made by a resistor roller 26. Once the sheet of recording paper P has reached the transfer region, the transfer charger 20 generates corona discharge or the like to transfer the toner image on the outer periphery of the photosensitive drum 14 onto the sheet of recording paper P, and then, the separating charger 21 separates the sheet of recording paper P from the outer periphery of the photosensitive drum 14.

A conveyer belt 28 conveys the sheet of recording paper P with the toner image transferred thereon to the fixing unit 27. The fixing unit 27 is composed of a fixing roller and the like and fixes the toner to the sheet of recording paper P by heat and pressure. A flapper 29 directs the sheet of recording paper P with the toner fixed to any one of an intermediate tray 30 or the staple sorter 31 (or the bookbinding machine 32 in the case of the image forming apparatus 1 provided with the bookbinding machine 32) under the control of the controller section 12.

When the image formation is performed in a multiple transfer mode (a mode in which a plurality of images are formed on the same surface of a sheet of recording paper P), the sheet of recording paper P conveyed to the intermediate tray 30 by conveyance rollers 33 to 36 is not turned over before further conveyed to a reconveyance roller 37. On the other hand, when the image formation is performed in a double-sided copying mode (a mode in which images are formed on the both surfaces of a sheet of recording paper P), the sheet of recording paper P is turned over in the intermediate tray 30 before further conveyed to the reconveyance roller 37. The reconveyance roller 37 conveys the sheet of recording paper P to the resist roller 26. The sheet of recording paper P having reached the resist roller 26 is conveyed again to the transfer region, subjected to the transfer processing, conveyed to the fixing unit 27 by the conveyer belt 28, subjected to the fixing processing, and then ejected to the staple sorter 31 (or the bookbinding machine 32).

The staple sorter 31 is intended to sort a plurality of sheets of recording paper P with the toner fixed thereon on a one-by-one basis to respective bins 31A within a predetermined sheet count when the image formation is performed in a continuous copying mode (a mode in which image formation is performed sequentially on a plurality of sheets of recording paper P). In the case where the image forming apparatus 1 is provided with the staple sorter 31 (shown in FIG. 1A), a stapling section 31B performs stapling under the control of the controller section 12.

On the other hand, the bookbinding machine (glue binder) 32 is intended to bind a plurality of sheets of recording paper P with the toner fixed into a book. In the case where the image forming apparatus 1 is provided with the glue binder 32 (shown in FIG. 1B), a binder section 32A binds a plurality of sheets of recording paper P into a bundle, pastes a spine on the bundle to complete a book, and stores the book in a stacker 32B under the control of the controller section 12.

Figure 2:
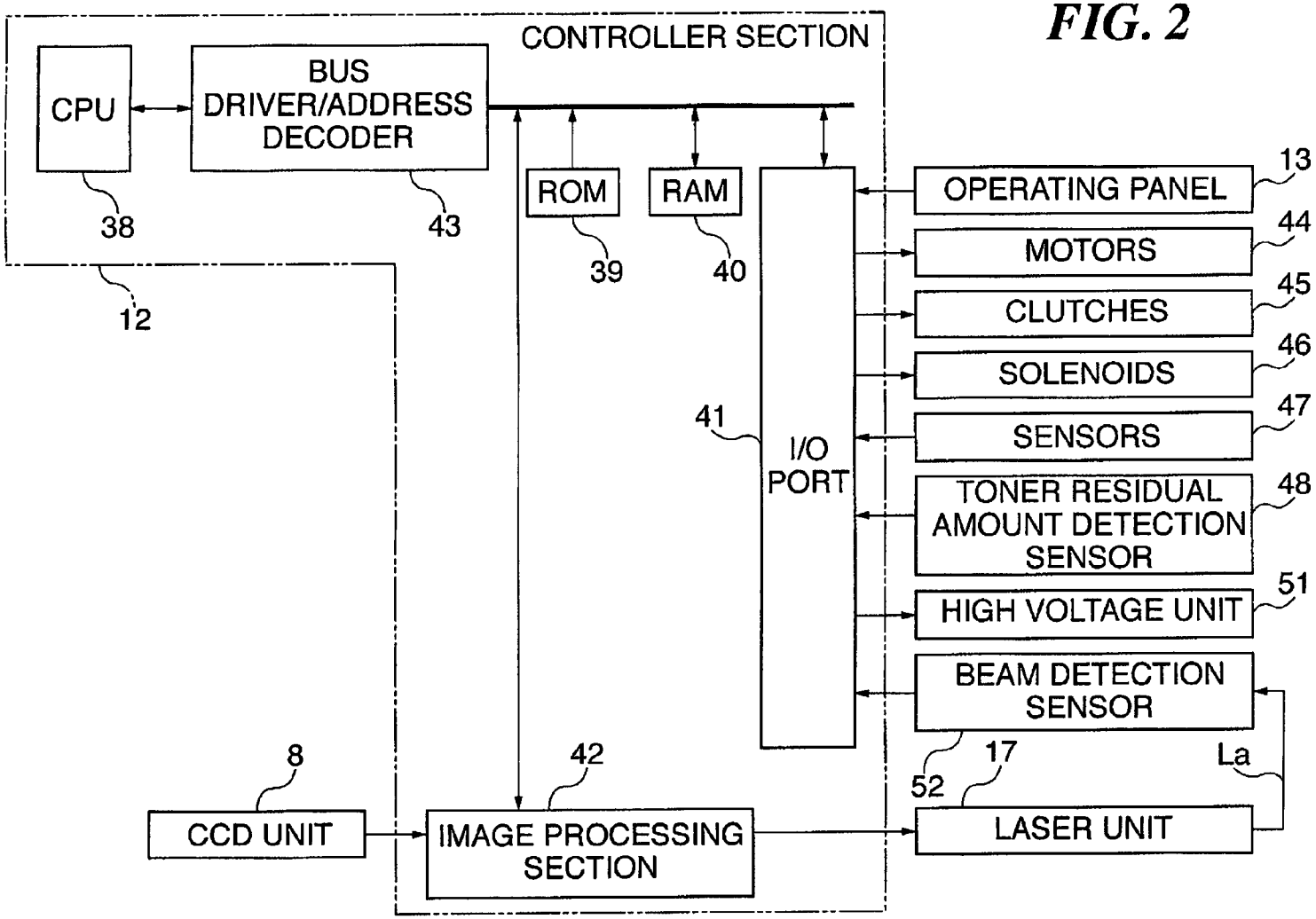
FIG. 2 is a block diagram showing an arrangement of a controller section of the image forming apparatus shown in FIG. 1.

FIG. 2 is a block diagram showing an arrangement of the controller section of the image forming apparatus shown in FIG. 1.

In FIG. 2, the controller section 12 has a CPU 38, a ROM 39, a RAM 40, an I/O port 41, an image processing section 42, and a bus driver/address decoder circuit 43.

The CPU 38 serves to mainly control the entire image forming apparatus 1. The ROM 39 serves to store a control procedure (control program) or the like for the entire image forming apparatus 1. The RAM 40 is a main storage device used as a data storage area, a work area or the like. The I/O port 41 serves as an interface between the controller section 12 and each of the components described later. The image-processing section 42 performs image processing of digital data input from the CCD unit 8 in response to a manipulation on an operating panel 13 by a user. The CPU 38 has an address bus and a data bus (not shown) that are connected to the ROM 39, the RAM 40, the I/O port 41 and the image processing section 42 via the bus driver/address decoder circuit 43.

To the I/O port 41, the operating panel 13, motors 44, electromagnetic clutches 45, electromagnetic solenoids 46, paper detection sensors 47, a toner residual amount detection sensor 48, a high voltage unit 51, and a beam detection sensor 52 are connected. The motors 44 are those for driving an essential mechanism, including a motor that drives the optical scanning unit, for example. The paper detection sensors 47 include a sensor that detects a sheet of recording paper P conveyed to the transfer region. The toner residual amount detection sensor 48 detects the amount of toner remaining in the developing device 18. The high voltage unit 51 supplies a high voltage to the primary charger 16, the transfer precharger 19, the transfer charger 20, and the separating charger 21. The beam detection sensor 52 is provided at a non-image area of the outer periphery of the photosensitive drum 14 and detects laser La emitted from the laser unit 17.

Figure 3:
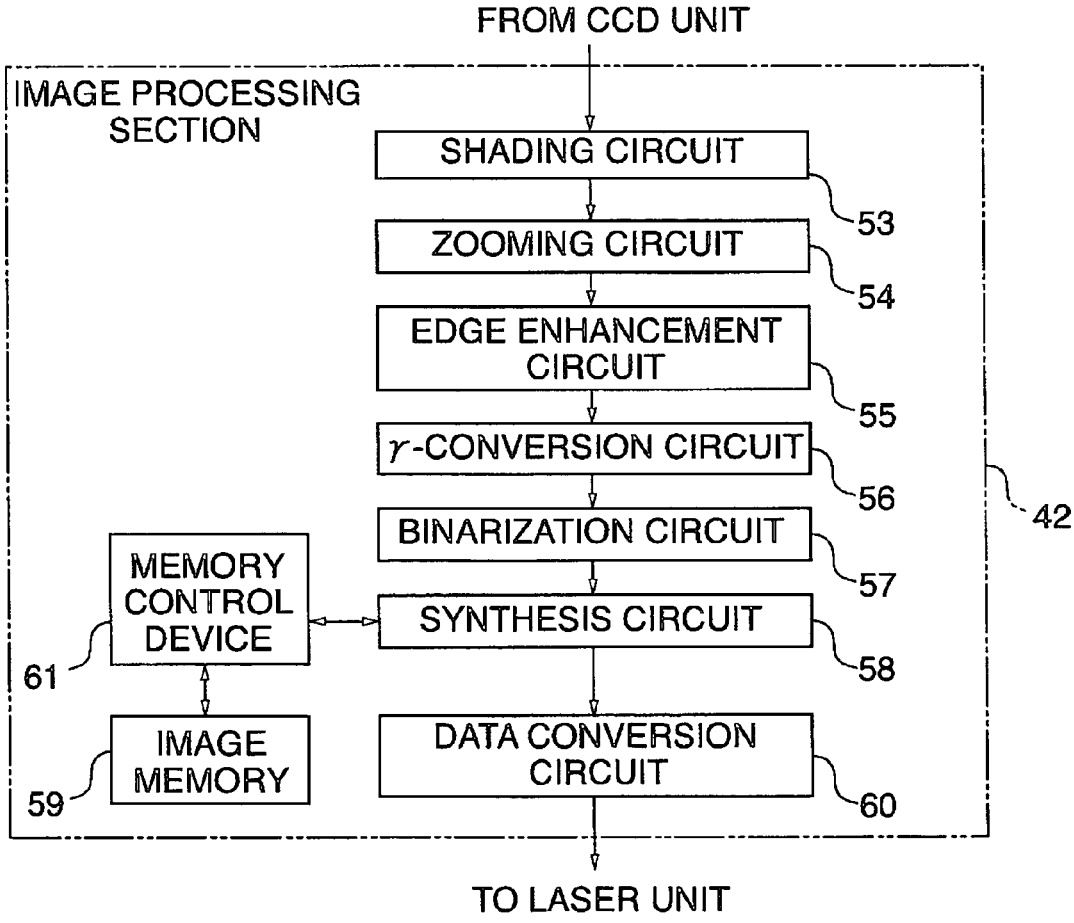
FIG. 3 is a block diagram showing an arrangement of an image processing section of the controller section shown in FIG. 2.

FIG. 3 is a block diagram showing an arrangement of the image processing section of the controller section shown in FIG. 2.

In FIG. 3, the image processing section 42 has a shading circuit 53, a zooming circuit 54, an edge enhancement circuit 55, a γ-conversion circuit 56, a binarization circuit 57, a synthesis circuit 58, an image memory 59, a data conversion circuit 60 and a memory control device 61.

Once digital data converted from analog data representative of the reflection light image of an original is input from the CCD unit 8 to the image processing section 42, the shading circuit 53 first corrects the digital data for variations between pixels. Then, the zooming circuit 54 performs a decimation processing on the digital data when the image formation mode is in a reduction copy mode or performs an interpolation processing on the digital data when the image formation mode is an enlargement copy mode.

Then, on the digital data having been subjected to the decimation or interpolation processing, the edge enhancement circuit 55 enhances edges of the image by second order differentiation in a window of 5 by 5 pixels, for example. The edge-enhanced digital data is luminance data, so that the digital data has to be converted into density data, and a gradation representation, such as intermediate density, has to be modified depending on the image formation mode before transferring the digital data to the laser unit 17. Thus, the γ-conversion circuit 56 converts the luminance data into density data through table search, and the binarization circuit 57 binarizes the density data, and then, the resulting data is input to the synthesis circuit 58.

Then, the synthesis circuit 58 selects one of or performs a logical addition of the input digital data and image data stored in the image memory 59, which may be a DRAM, and outputs the selected data or the result of the logical addition to the data conversion circuit 60. Here, reading/writing of image data from/to the image memory 59 is controlled by the memory control device 61. Then, the data conversion circuit 60 produces digital data for the two light sources in the laser unit 17 that has pulses suitable for the image formation mode set through user manipulations on the operating panel 13, and outputs the digital data (pulses) to the laser unit 17.

Figure 4:
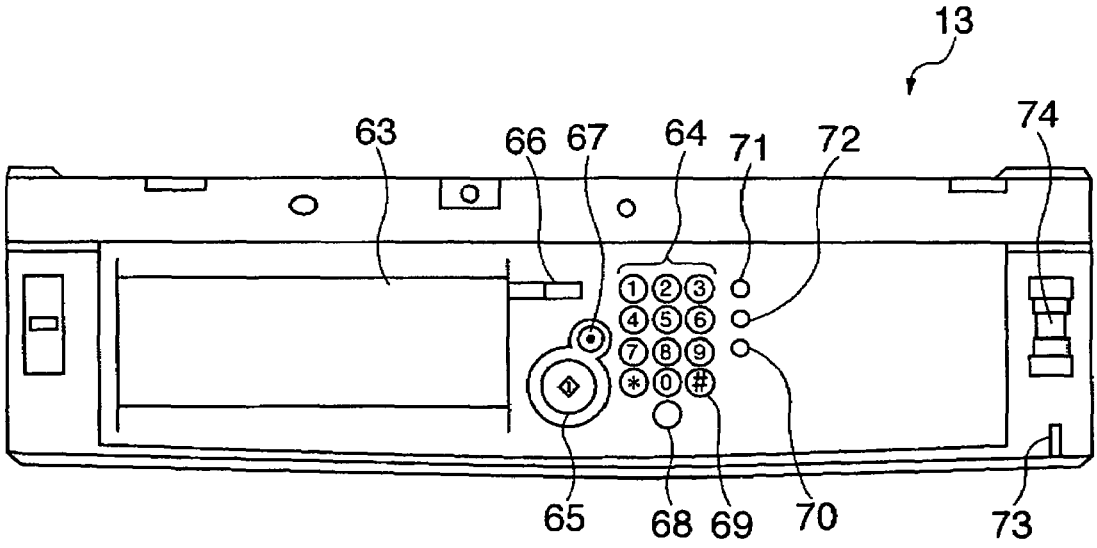
FIG. 4 is a top view showing an arrangement of an operating panel of the image forming apparatus shown in FIG. 1.

FIG. 4 is a top view showing an arrangement of the operating panel of the image forming apparatus shown in FIG. 1.

In FIG. 4, the operating panel 13 is composed of a touch panel, for example, and is used to set operation modes concerning transfer and fixing, the number of sheets of recording paper P for image formation, the image density on the sheets of recording paper P or the like and to issue instructions for image processing to the controller section 12. The operating panel 13 has a display section 63, a ten-key numerical pad 64, a start key 65, a reset key 66, a stop key 67, a clear key 68, a pound key 69, an ID key 70, a warm-up key 71, an interruption key 72, a power-supply indicator lamp 73, and a power supply switch 74.

The display section 63 provides a display of an instruction message or the like to a user. The ten-key numerical pad 64 is manipulated to enter the number of copies or the like. The start key 65 is manipulated to instruct the image forming apparatus 1 to start image formation. The reset key 66 is manipulated to recover the initial settings of operation modes or the like. The stop key 67 is manipulated to stop the entire operation of the image forming apparatus 1. The clear key 68 is manipulated to recover the initial set value of the entered number of copies or the like. The pound key 69 is manipulated when using an option on the image forming apparatus 1. The ID key 70 is manipulated to establish an ID function that permits only a specified user to manipulate the image forming apparatus.

The warm-up key 71 is manipulated to turn on or off a warm-up mode. The interruption key 72 is manipulated to interrupt a copy operation to make the image forming apparatus 1 perform another image formation. The power-supply indicator lamp 73 informs by light that the image forming apparatus 1 is no energized. The power supply switch 74 is manipulated to turn on or off the image forming apparatus 1. When the image forming apparatus 1 is in the OFF state, a DC power supply and a secondary circuit connected to the DC power supply (both not shown) are energized, while a primary circuit connected to the DC power supply and the display section 63 are in the OFF state. On the other hand, when the image forming apparatus 1 is in the ON state, the DC power supply, the primary circuit, the secondary circuit, and the display section 63 are all in the ON state.

Figure 5:
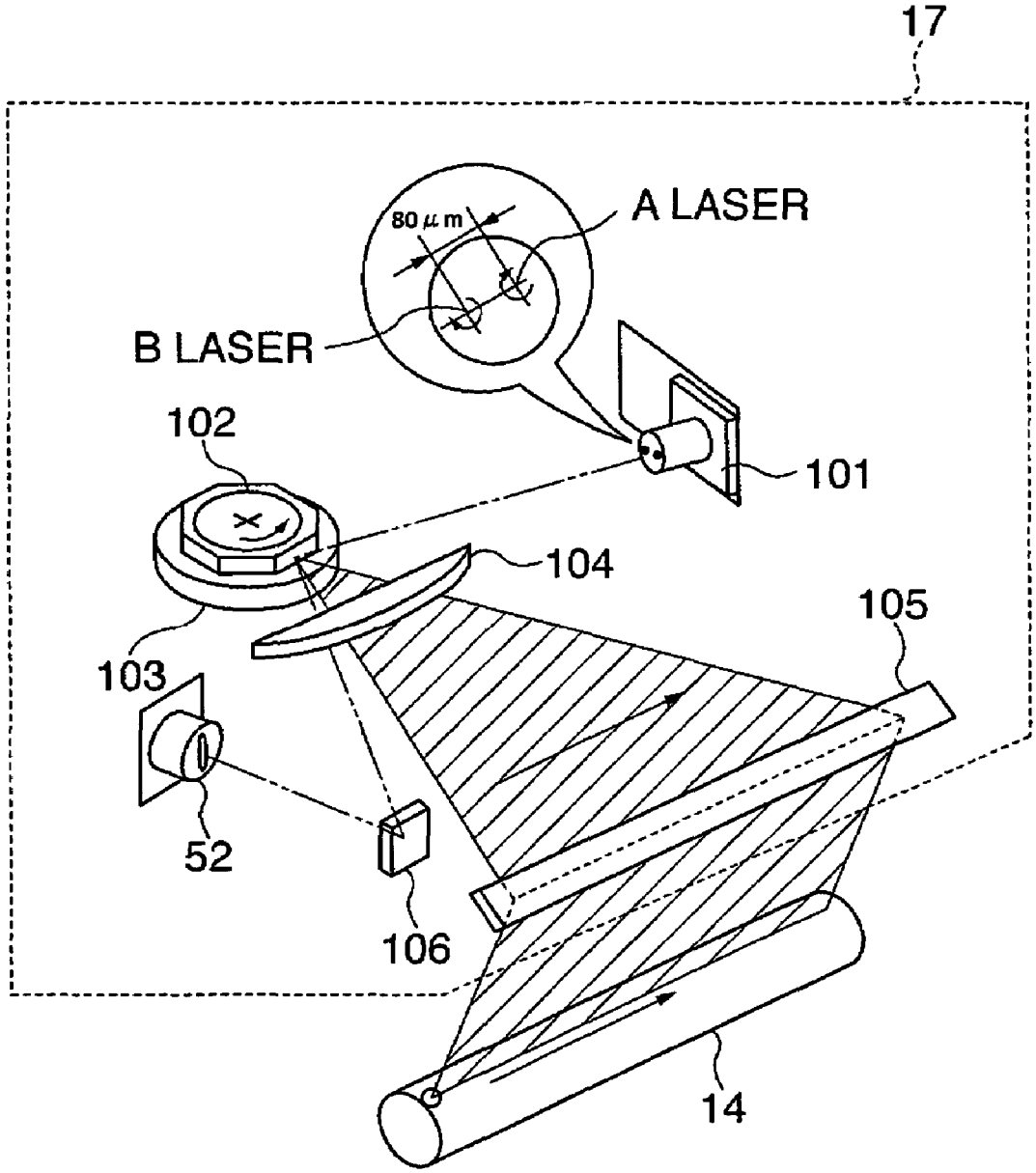
FIG. 5 is a perspective view schematically showing an arrangement of a laser unit and the like of the image forming apparatus shown in FIG. 1.

FIG. 5 is a perspective view schematically showing an arrangement of the laser unit and the like of the image forming apparatus shown in FIG. 1.

In FIG. 5, the laser unit 17 has a laser light emitting section 101, a polygon mirror 102, a polygon motor 103, an image forming lens 104, a reflection mirror 105, and a BD reflection mirror 106.

The laser light emitting section (semiconductor laser) 101 has two light emitting units that are spaced apart from each other by 80 μm, for example, and are inclined so that the two laser beams (A laser beam and B laser beam) scan the photosensitive drum 14 at a predetermined interval. The polygon mirror 102 is rotationally driven by the polygon motor 103 to reflect the laser beams. The reflection mirror 105 reflects the laser beams having passed through the image forming lens 104 onto the photosensitive drum 14. The photosensitive drum 14 is exposed to and scanned by the laser beams, and thus, an electrostatic latent image corresponding to the digital data produced by the controller section 12 is formed on the photosensitive drum 14. The BD reflection mirror 106 launches the laser beams into the beam detection sensor 52.

Now, an arrangement of a photosensitive drum temperature control system serving as a temperature detecting device and a temperature control device according to this embodiment will be described with reference to FIG. 6.

Figure 6:
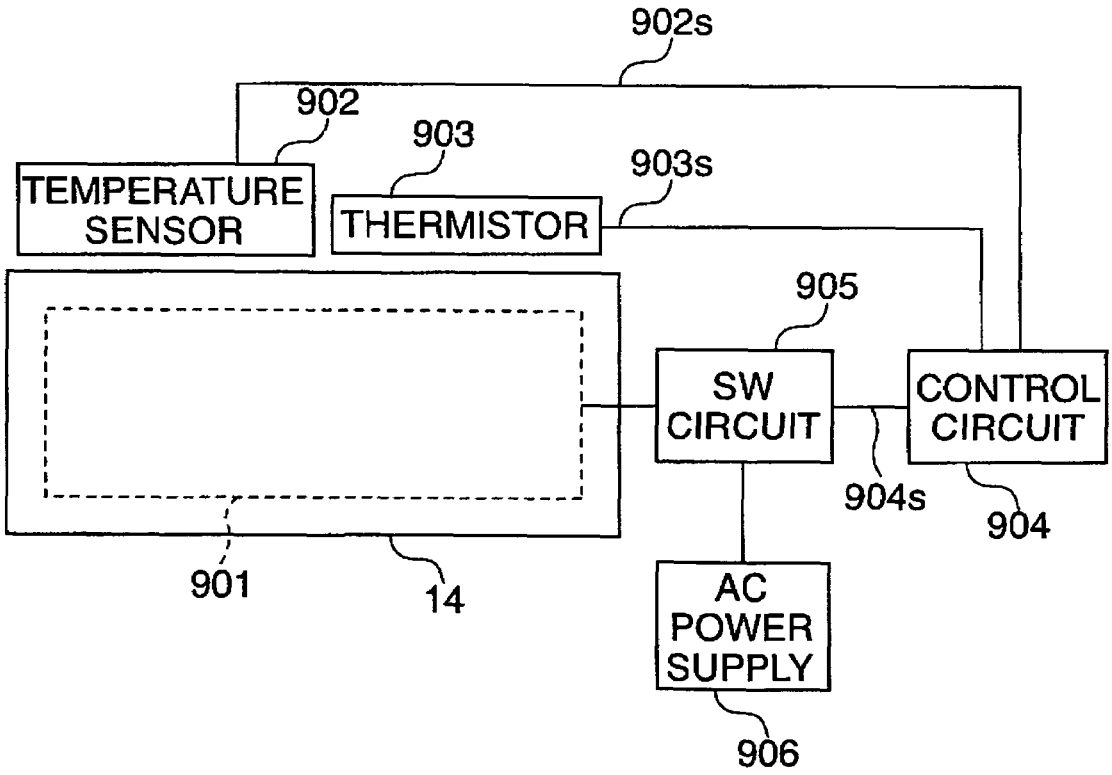
FIG. 6 is a block diagram showing an arrangement of a photosensitive drum temperature control system of the image forming apparatus shown in FIG. 1.

FIG. 6 is a block diagram showing an arrangement of the photosensitive drum temperature control system of the image forming apparatus shown in FIG. 1.

In FIG. 6, the photosensitive drum temperature control system has a thermopile temperature sensor 902, a non-contact thermistor 903, a control circuit 904, a switching (SW) circuit 905, and an AC power supply 906. Here, it is to be noted that the control circuit 904 according to this embodiment has a structure shown in FIG. 7, while the control circuit 904 according to a second embodiment described later has a structure shown in FIG. 10.

The photosensitive drum 14 incorporates a heater 901. The thermopile temperature sensor 902 and the non-contact thermistor 903 detect the surface temperature of the photosensitive drum 14 and provide an output signal 902*s* and an output signal 903*s* to the control circuit 904, respectively. The control circuit 904 grasps (detects) the surface temperature of the photosensitive drum 14 based on the output signals 902*s* and 903*s*. In addition, the control circuit 904 outputs an output signal 904*s* to drive the SW circuit 905 and controls power supply from the AC power supply 906 to the heater 901, thereby keeping the surface temperature of the photosensitive drum 14 constant.

The thermopile temperature sensor 902 has a thermopile element that detects a relative temperature and a thermistor that detects an absolute temperature. The sensor 902 is disposed facing the photosensitive drum 14 out of contact therewith so that the sensor can detect infrared radiation from the surface of the photosensitive drum 14 via a lens. On the other hand, the non-contact thermistor 903 is disposed quite close to the photosensitive drum 14, within 1 mm from the photosensitive drum 14, for example, out of contact therewith so that the thermistor can detect the surface temperature of the photosensitive drum 14 based on a convection heat (or the quantity of infrared radiation) in the vicinity of the photosensitive drum 14.

Now, representative temperature detection accuracies and conditions therefor of the thermopile temperature sensor 902 and the non-contact thermistor 903 will be described.

The initial temperature detection accuracy of the thermopile temperature sensor 902 including a signal receiving circuit is generally determined by the following two conditions (representative values thereof are also shown):

(1) the temperature detection accuracy of the thermopile temperature sensor 902: ±0.5 degrees Celsius depending on adjustment during manufacture; and (2) the temperature detection accuracy of the receiving circuit: ±0.5 degrees Celsius.

The thermopile temperature sensor 902 has a total variation of ±1.0 degrees Celsius.

Since the thermopile temperature sensor 902 collects the infrared radiation emitted from the surface of the photosensitive drum 14 via a lens, a variation of the distance between the photosensitive drum and the sensor within a typical mounting tolerance does not cause any shift of the detected temperature. However, after a certain period of operation of the image forming apparatus 1 (after aging of the image forming apparatus 1), contamination of the lens of the thermopile temperature sensor 902 is accumulated, so that the amount of infrared radiation passing through the lens decreases, and the detected temperature is shifted to lower temperatures. The shift depends on the degree of contamination of the lens, and thus, in the worst case where maintenance is not appropriately done, a quite significant shift has to be taken into account.

On the other hand, the non-contact thermistor 903 has a single thermistor disposed out of contact with the photosensitive drum 14 but within a distance of 1 mm from the photosensitive drum 14, for example. The initial temperature detection accuracy of the non-contact thermistor 903 including a signal receiving circuit is determined by the following three conditions (representative values thereof are also shown):

(1) the temperature detection accuracy of the non-contact thermistor 903: ±0.5 degrees Celsius;

(2) the temperature detection accuracy of the receiving circuit: ±0.5 degrees Celsius; and (3) the distance between the photosensitive drum 14 and the non-contact thermistor 903: ±1 degrees Celsius (with respect to a variation of the distance of 0.6 mm±0.2 mm).

The thermopile temperature sensor 902 has a total variation of ±2.0 degrees Celsius.

Since the non-contact thermistor 903 detects the convection heat in the vicinity of the photosensitive drum 14, the effect of contamination occurring in the course of operation of the image forming apparatus can be ignored. Thus, the initial temperature detection accuracy of the non-contact thermistor 903 does not change after a certain period of operation of the image forming apparatus.

As can be seen from the above description, the initial temperature detection accuracy of the thermopile temperature sensor 902 is better than that of the non-contact thermistor 903, although the detected temperature of the thermopile temperature sensor 902 shifts in the course of operation of the image forming apparatus 1.

Now, an arrangement of the control circuit 904 of the photosensitive drum temperature control system according to this embodiment will be described with reference to FIG. 7.

Figure 7:
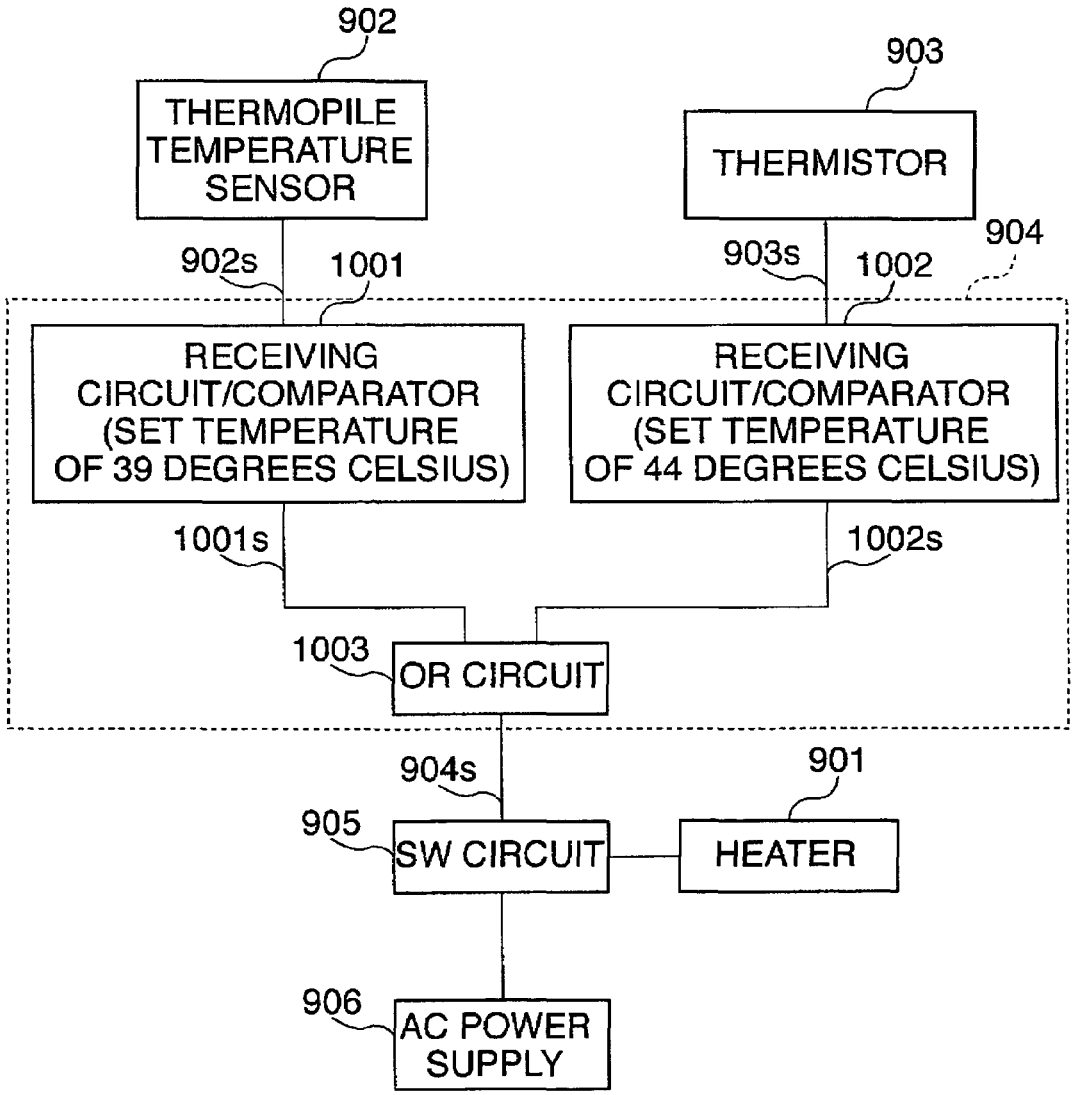
FIG. 7 is a block diagram showing an arrangement of a control circuit of the photosensitive drum temperature control system shown in FIG. 6.

FIG. 7 is a block diagram showing an arrangement of the control circuit of the photosensitive drum temperature control system shown in FIG. 6.

In FIG. 7, the control circuit 904 has a comparator including a signal receiving circuit (simply referred to as comparator hereinafter) 1001, a comparator including a signal receiving circuit (simply referred to as comparator hereinafter) 1002, and an OR circuit 1003.

The output signal 902*s* of the thermopile temperature sensor 902 is input to the comparator 1001. The comparator 1001 is configured to output an off signal 1001*s* when the output signal 902*s* of the thermopile temperature sensor 902 becomes equal to a value (voltage) corresponding to a preset temperature, for example, 39 degrees Celsius. The output signal 903*s* of the non-contact thermistor 903 is input to the comparator 1002. The comparator 1002 is configured to output an off signal 1002*s* when the output signal 903*s* of the non-contact thermistor 903 becomes equal to a value (voltage) corresponding to a preset temperature, for example, 44 degrees Celsius.

The off signal 1001*s* output by the comparator 1001 and the off signal 1002*s* output by the comparator 1002 are input to the OR circuit 1003, and the OR circuit 1003 provides an output signal 904*s*, which is input to the SW circuit 905. The SW circuit 905 controls the power supply from the AC power supply 906 to the heater 901 in accordance with the output signal 904*s* of the OR circuit 1003.

Now, a temperature control process performed by the control circuit 904 will be described with reference to FIGS. 8 and 9.

Figure 8:
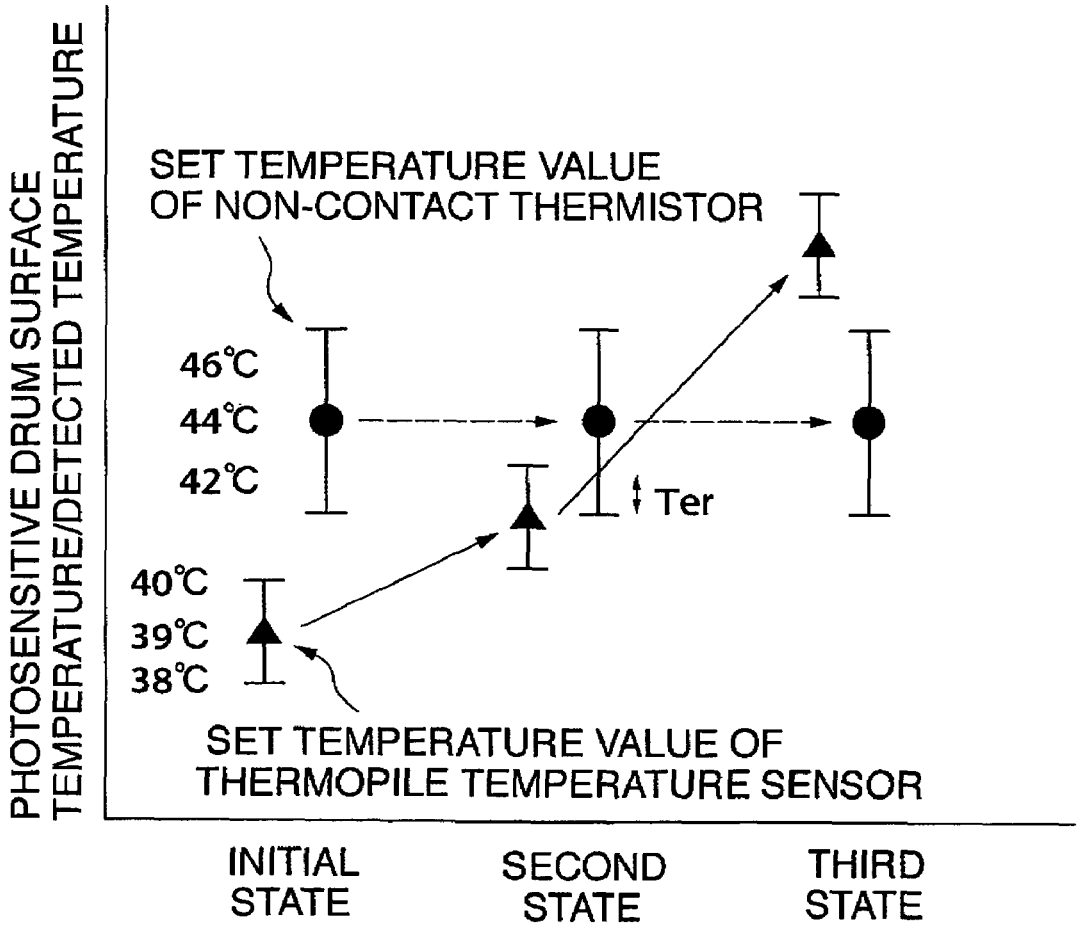
FIG. 8 is a diagram for illustrating a temperature control process carried out by the photosensitive drum temperature control system shown in FIG. 6.
Figure 9:
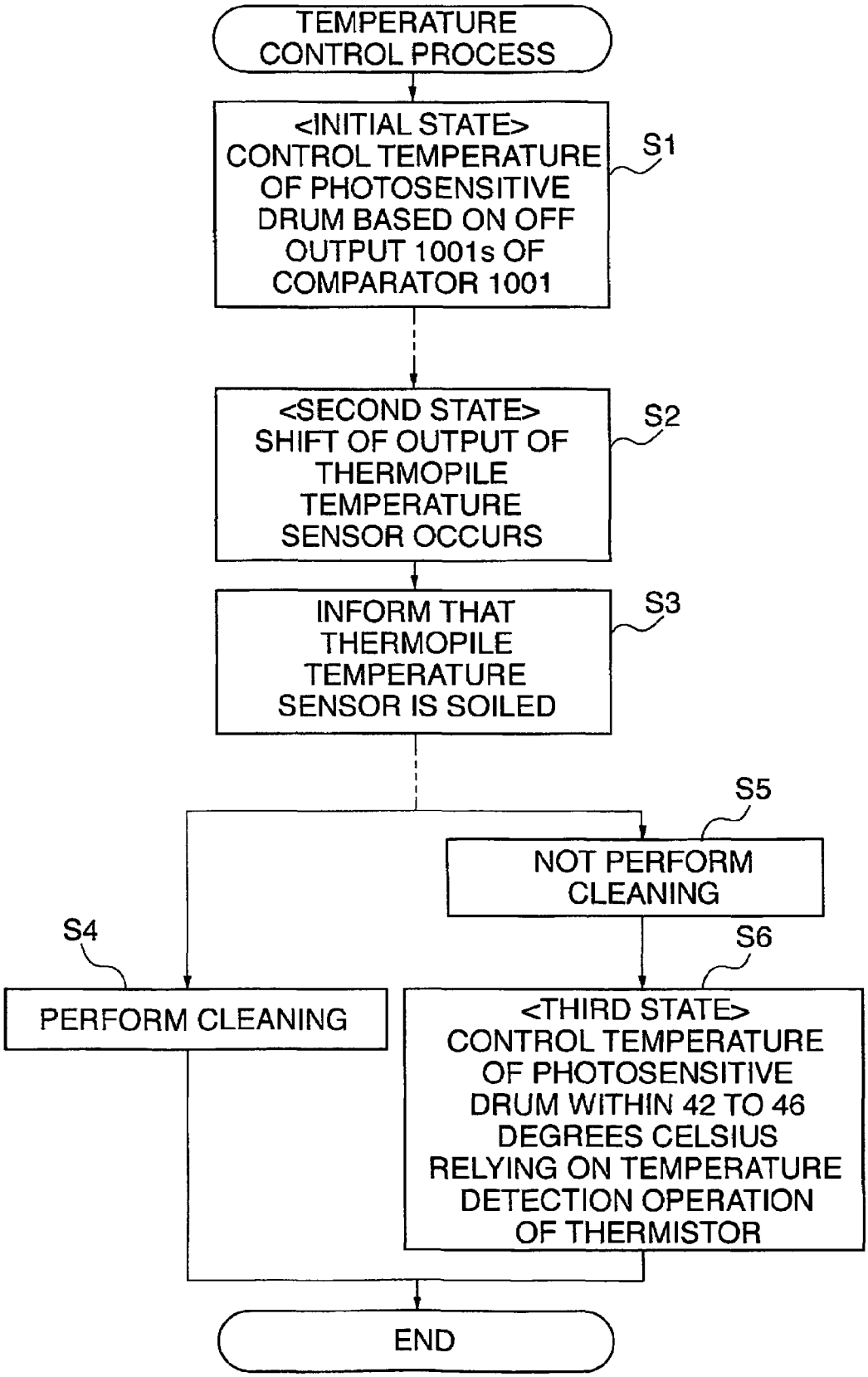
FIG. 9 is a flowchart schematically showing the temperature control process carried out by the photosensitive drum temperature control system shown in FIG. 6.

FIG. 8 is a diagram useful in explaining the temperature control process carried out by the photosensitive drum temperature control system shown in FIG. 6, and FIG. 9 is a flowchart schematically showing the temperature control process carried out by the photosensitive drum temperature control system shown in FIG. 6.

In FIGS. 8 and 9, initially, as shown as an initial state, the temperature set in the comparator 1001 is 39 degrees Celsius. Taking into account the variation of the temperature detection accuracy of the thermopile temperature sensor 902 (±1.0 degrees Celsius) described above, the comparator 1001 actually outputs the off signal 1001*s* within an off output range (38 to 40 degrees Celsius), which is equivalent to a threshold thereof. In other words, when the surface temperature of the photosensitive drum 14 reaches the off output range (38 to 40 degrees Celsius) of the comparator 1001, the control circuit 904 stops heating of the photosensitive drum 14 by the heater 901.

On the other hand, the temperature set in the comparator 1002 is 44 degrees Celsius. Taking into account the variation of the temperature detection accuracy of the non-contact thermistor 903 (±2.0 degrees Celsius) described above, the comparator 1002 actually outputs the off signal 1002*s* within an off output range (42 to 46 degrees Celsius), which is equivalent to a threshold thereof. In other words, when the surface temperature of the photosensitive drum 14 reaches the off output range (42 to 46 degrees Celsius) of the comparator 1002, the control circuit 904 stops heating of the photosensitive drum 14 by the heater 901.

As described above, the off output range (38 to 40 degrees Celsius) of the comparator 1001 is set lower than the off output range (42 to 46 degrees Celsius) of the comparator 1002. Thus, even with the variations of the temperature detection accuracy taken into account, the temperature control of the photosensitive drum 14 is initially performed based on the off signal 1001*s* of the comparator 1001 (step S1). However, in the course of operation of the image forming apparatus 1, contamination of the lens of the thermopile temperature sensor 902 gradually accumulates, and the detected temperature is shifted to lower temperatures. This state is shown as a second state after a certain period of operation, in which the off output range of the comparator 1001 is shifted due to the shift of the output of the thermopile temperature sensor 902 with respect to the actual surface temperature of the photosensitive drum 14 (step S2).

In this second state, depending on the variation of the temperature detection accuracy of the thermopile temperature sensor 902 and the variation of the temperature detection accuracy of the non-contact thermistor 903, a state (a region Ter) may occur in which the comparator 1002 operates to output an off signal at a lower temperature than the comparator 1001. This is not a desirable state in which the thermopile temperature sensor 902 is properly maintained. Thus, if the temperature detected by the non-contact thermistor 903 exceeds a predetermined range, the control circuit 904 determines that an abnormality (contamination of the lens) occurs in the thermopile temperature sensor 902 and stops heating of the photosensitive drum 14 by the heater 901. Alternatively, the control circuit 904 may inform the user of the contamination of the lens by displaying an alert message but not stop heating in order that the image forming operation itself can continue.

Since the temperature detection accuracy of the thermopile temperature sensor 902 and the non-contact thermistor 903 varies, the SW circuit 905 may have a counter. More preferably, in this case, the control circuit 904 only informs the user of the occurrence of the state in which the comparator 1002 operates to output an off signal at a lower temperature than the comparator 1001 by displaying an alert message without stopping heating to continue the image forming operation itself before the number of times of occurrence of the state reaches a predetermined value, and stops heating when the number of times of occurrence of the state reaches the predetermined value.

Furthermore, the SW circuit 905 may have a timer, instead of the counter. In this case, the control circuit 904 may only inform the user of the occurrence of the state in which the comparator 1002 operates to output an off signal at a lower temperature than the comparator 1001 by displaying an alert message without stopping heating to continue the image forming operation itself before the duration of the state reaches a predetermined value, and stop heating when the duration of the state reaches the predetermined value.

Furthermore, if the abnormality is eliminated (the contamination of the lens is cleaned) before the predetermined number of times of occurrence of the state is reached or the duration of the state reaches the predetermined value, the temperature control of the photosensitive drum 14 based on the off signal 1001*s* of the comparator 1001 is resumed.

The control circuit 904 displays an alert message on the display section 63 of the operating panel 13 via the controller section 12, thereby informing a serviceman or user of the contamination of the lens of the thermopile temperature sensor 902 (displaying the alert message) (step S3) to prompt the serviceman or user to clean the lens. In response to the message, the serviceman or user cleans the lens of the thermopile temperature sensor 902 (step S4).

If appropriate maintenance of the thermopile temperature sensor 902 is not done (step S5), in the worst case, the accumulated contamination of the lens of the thermopile temperature sensor 902 can result in a third state after a certain period of operation, in which the comparator 1002 operates to output an off signal at a lower temperature than the comparator 1001 including all the variations. Even in this third state, relying on the temperature detecting operation of the photosensitive drum 14 by the non-contact thermistor 903, the temperature of the photosensitive drum 14 is controlled within a range of 42 to 46 degrees Celsius (step S6), so that the image forming apparatus 1 is prevented from failing due to melting/hardening of the toner.

Thus, if appropriate maintenance of the thermopile temperature sensor 902 is not done, the photosensitive drum 14 can be continuously controlled without stopping heating of the photosensitive drum 14, based on the temperature of the photosensitive drum 14 detected by the non-contact thermistor 903. In this case, the image forming apparatus 1 can be continuously used while prompting for lens cleaning by displaying an alert message. That is, when the state where the comparator 1002 operates to output an off signal at a lower temperature than the comparator 1001 occurs (once or a predetermined number of times), the comparator 1002 is used for temperature control so that the image forming apparatus 1 can be prevented from failing and continuously used. Thus, the convenience of users can be ensured while protecting the apparatus.

As described above, if the contamination of the lens of the thermopile temperature sensor 902 causes a shift of the detected temperature, the temperature of the photosensitive drum 14 is controlled based on the temperature of the photosensitive drum 14 detected by the non-contact thermistor 903. That is, even when the thermopile temperature sensor 902 is soiled, since the non-contact thermistor 903 serves as a limiter, the surface temperature of the photosensitive drum 14 can be controlled so as not to occur an abnormal temperature that causes failure of the image forming apparatus 1.

As described above, according to this embodiment, if the state where the comparator 1002 operates to output an off signal at a lower temperature than the comparator 1001 occurs (if the detection information of or the temperature detected by the non-contact thermistor 903 exceeds a predetermined range), it is alerted that the thermopile temperature sensor 902 is soiled. In addition, heating of the photosensitive drum 14 by the heater 901 is stopped. Thus, the accuracy of the temperature control of the photosensitive drum 14 can be maintained within a certain range, so that adverse effects of the contamination of the lens of the thermopile temperature sensor 902 can be avoided.

Furthermore, if the contamination of the thermopile temperature sensor 902 is not cleaned, or in other words, if the state where the comparator 1002 operates to output an off signal at a lower temperature than the comparator 1001 continues, the temperature of the photosensitive drum 14 is controlled based on the output of the comparator 1002.

That is, it is possible to solve a conventional problem that inadequate temperature control of the photosensitive drum causes melting/hardening of toner on the development sleeve in contact with the photosensitive drum or deterioration of the stability of images due to variations of the surface temperature of the photosensitive drum. In addition, neither a contact/separation mechanism for a contact thermistor nor a cleaning member and a driving mechanism thereof for the lens of the thermopile temperature sensor are required, so that problems concerning installation space and cost can be solved.

In addition, if the image forming operation can be continued only by displaying an alert message as described above, the length of time in which the image forming apparatus is out of service can be reduced to a minimum.

Next, a description will be given of a second embodiment of the present invention.

Figure 10:
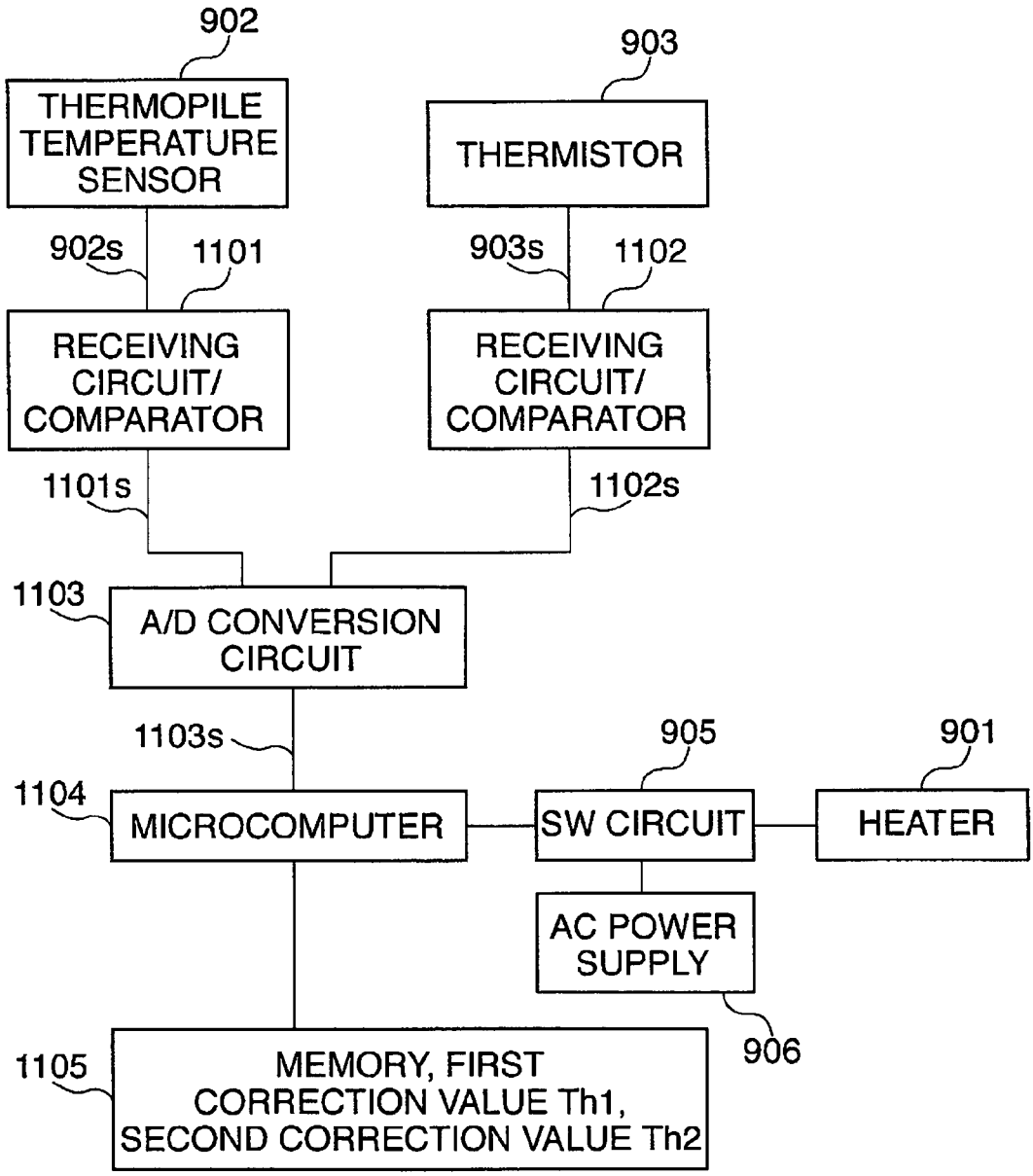
FIG. 10 is a block diagram showing an arrangement of a control circuit of a photosensitive drum temperature control system of an image forming apparatus according to a second embodiment of the present invention.

The second embodiment of the present invention differs from the first embodiment described above in that a non-contact thermistor 903 is not used as a limiter but used for correction of the temperature detected by a thermopile temperature sensor 902 and that a control circuit 904 has an arrangement shown in FIG. 10. The remaining components according to this embodiment are the same as the corresponding components according to the first embodiment described above (FIGS. 1 to 6), and hence descriptions thereof will be omitted.

Now, an arrangement of the control circuit 904 of the photosensitive drum temperature control system according to this embodiment will be described with reference to FIG. 10.

FIG. 10 is a block diagram showing an arrangement of the control circuit of the photosensitive drum temperature control system of the image forming apparatus according to the second embodiment of the present invention.

In FIG. 10, the control circuit 904 has a signal receiving circuit 1101, a signal receiving circuit 1102, an A/D conversion circuit 1103, a microcomputer 1104, and a memory 1105.

The thermopile temperature sensor 902 provides an output signal 902*s*, which is input to the receiving circuit 1101. The receiving circuit 1101 provides an output signal 1101*s*, which is input to the A/D conversion circuit 1103. The non-contact thermistor 903 provides an output signal 903*s*, which is input to the receiving circuit 1102. The receiving circuit 1102 provides an output signal 1102*s*, which is input to the A/D conversion circuit 1103.

The output signals 1101*s* and 1102*s* input to the A/D conversion circuit 1103 are converted to digital values, and the microcomputer 1104 reads the digital values. Based on the digital values, the microcomputer 1104 controls a SW circuit 905 to control the power supply from an AC power supply 906 to a heater 901. The memory 1105 is connected to the microcomputer 1104 and stores two correction values (first and second correction values).

Now, a temperature control process performed by the control circuit 904 will be described with reference to FIGS. 11 and 12.

Figure 11:
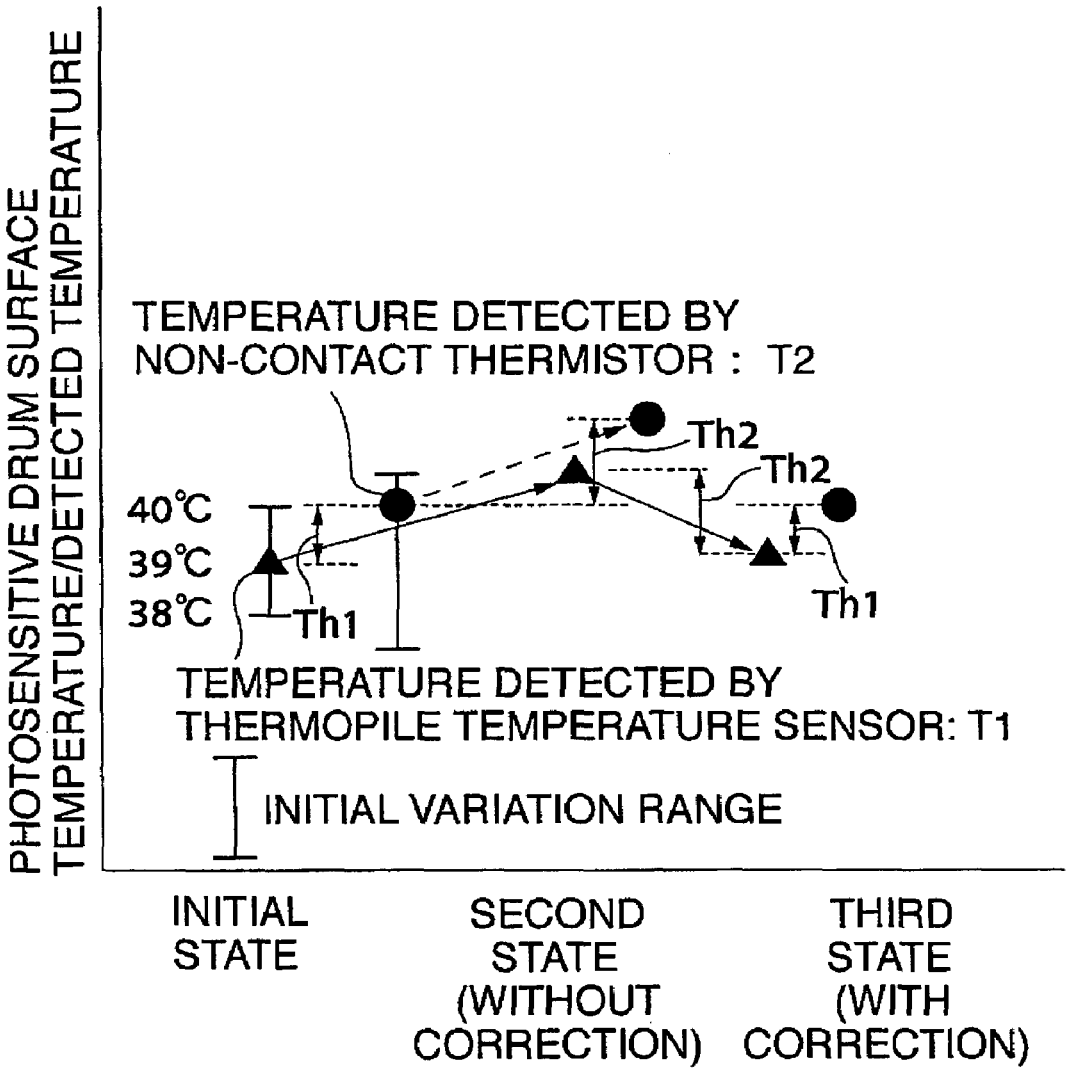
FIG. 11 is a diagram for illustrating a temperature control process carried out by the photosensitive drum temperature control system shown in FIG. 10.
Figure 12:
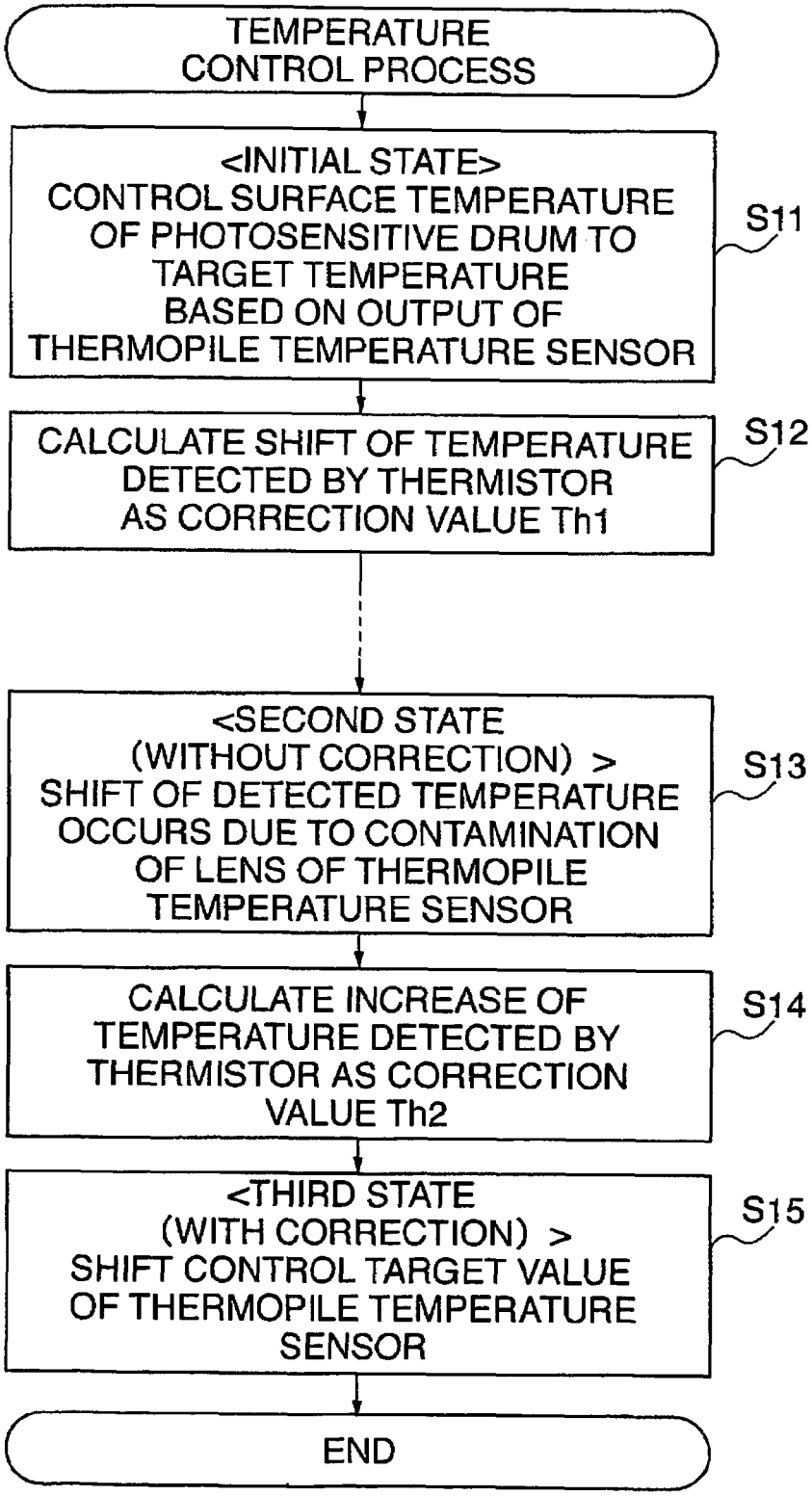
FIG. 12 is a flowchart schematically showing the temperature control process carried out by the photosensitive drum temperature control system shown in FIG. 10.
Figure 13:
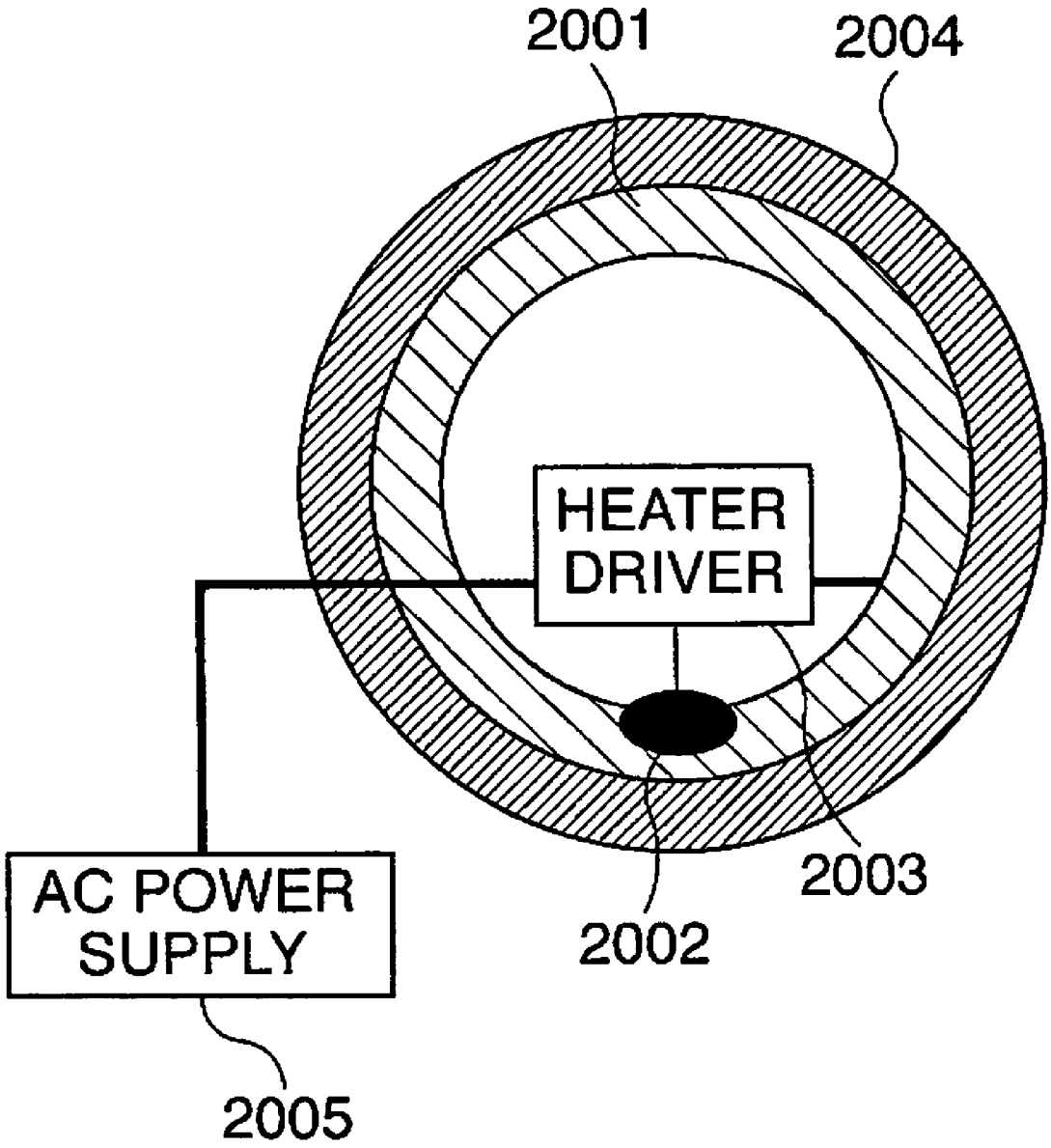
FIG. 13 PRIOR ART
FIG. 13 is a diagram for illustrating temperature control of a photosensitive drum according to prior-art example 1.
Figure 14:
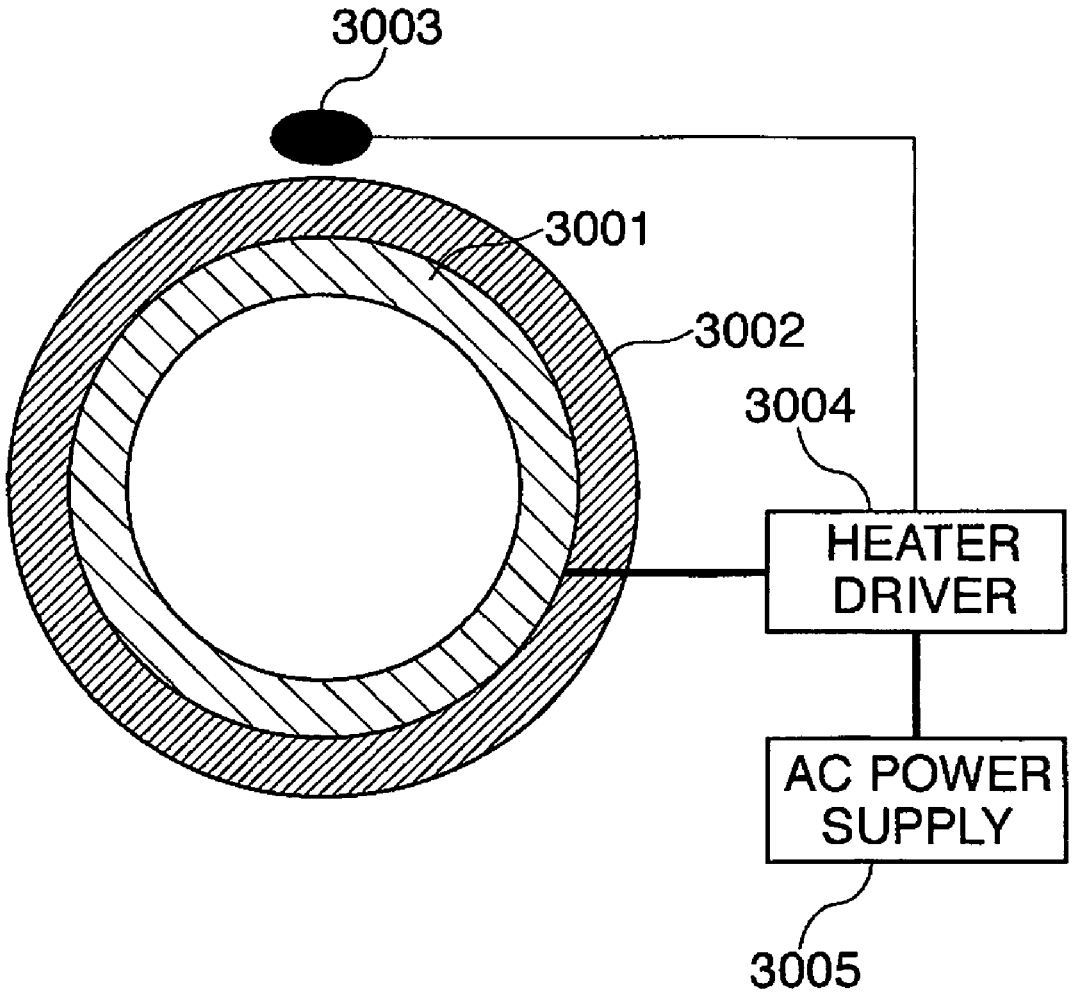
FIG. 14 PRIOR ART
FIG. 14 is a diagram for illustrating temperature control of a photosensitive drum according to prior-art example 2.
Figure 15:
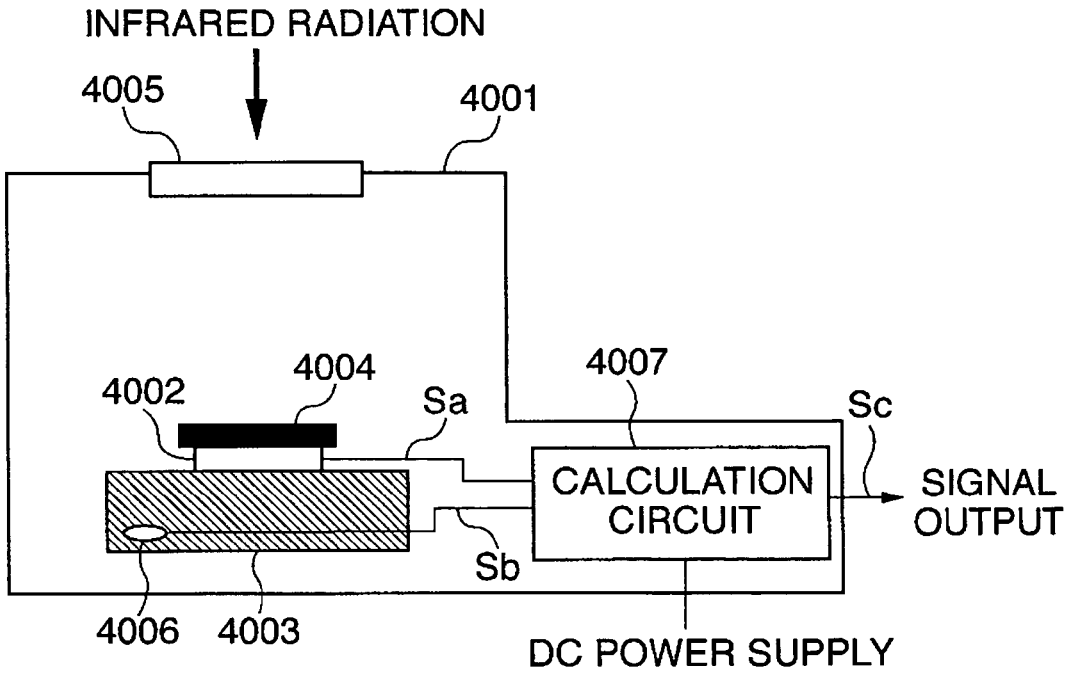
FIG. 15 PRIOR ART
FIG. 15 is a diagram showing an arrangement of a thermopile temperature sensor according to prior-art example 3.

FIG. 11 is a diagram for illustrating the temperature control process carried out by the photosensitive drum temperature control system shown in FIG. 10, and FIG. 12 is a flowchart schematically showing the temperature control process carried out by the photosensitive drum temperature control system shown in FIG. 10.

In FIGS. 11 and 12, initially, as shown as an initial state, the microcomputer 1104 controls the surface temperature of the photosensitive drum 14 to a target temperature T1 (39 degrees Celsius, for example) based on the output signal of the thermopile temperature sensor 902 (step S11).

Then, from a temperature T1 detected by the thermopile temperature sensor 902 and a temperature T2 detected by the non-contact thermistor 903 during temperature control of the photosensitive drum 14, the microcomputer 1104 calculates a shift of the temperature detected by the non-contact thermistor 903 as a first correction value Th1 according to the following formula (1) (step S12).

$$Th1 = T2 - T1 \quad (1)$$

Furthermore, the microcomputer 1104 stores the first correction value Th1 in the memory 1105.

Using the first correction value Th1, it is possible to correct a greater portion of the initial variations of the temperature detected by the non-contact thermistor 903 described with regard to the first embodiment compared to the variation of the temperature detected by the thermopile temperature sensor 902. The calculation of the first correction value Th1 can be performed at the time of shipment of the image forming apparatus 1. However, taking into account the possibility that the distance between the photosensitive drum 14 and the non-contact thermistor 903 varies during replacement or the like of the photosensitive drum 14 for maintenance, the calculation may be performed at the time of maintenance.

After a certain period of operation of the image forming apparatus 1, a shift of the detected temperature occurs due to contamination of the lens of the thermopile temperature sensor 902. In FIG. 11, a case where a control target temperature of the thermopile temperature sensor 902 is not corrected is shown as a second state after a certain period of operation (without correction). The temperature of the photosensitive drum 14 increases by a value corresponding to the shift of the detected temperature due to the contamination of the lens of the thermopile temperature sensor 902, and as a result, the temperature detected by the non-contact thermistor 903 increases (step S13).

Thus, the microcomputer 1104 calculates the increase Th2 of the temperature detected by the non-contact thermistor 903 as a second correction value according to the following formula (2) (step S14).

$$Th2=T2-T1-Th1 \quad (2)$$

The microcomputer 1104 shifts the control target temperature of the thermopile temperature sensor 902 by the calculated second correction value Th2 (step S15), resulting in a third state after a certain period of operation (with correction).

The microcomputer 1104 calculates a new control target temperature T2' according to the following formula (3).

$$T2'=T1-Th2 \quad (3)$$

As described above, a shift of the temperature detected by the non-contact thermistor 903 caused in the course of operation of the image forming apparatus 1 is corrected during the temperature control of the photosensitive drum 14 based on the temperature detected by the thermopile temperature sensor 902, whereby the temperature of the photosensitive drum 14 can be kept constant without variations in the course of operation of the image forming apparatus 1.

Since the second correction value Th2 is a variation in the course of operation of the image forming apparatus 1 over a certain time period, the second correction value Th2 is preferably calculated at regular time intervals or every a predetermined number of images formed. For example, if the second correction value Th2 is calculated and updated every day before the first image forming job or every a predetermined number of (1000, for example) images formed, it is possible to suppress to a minimum the temperature variation of the photosensitive drum 14 caused by variations in the course of operation of the image forming apparatus 1 over a certain time period.

As described above, according to this embodiment, the detection information of the thermopile temperature sensor 902 is corrected based on the detection information of the non-contact thermistor 903. In addition, a reference correction value for the detection information of the non-contact thermistor 903 is produced based on the detection information of the thermopile temperature sensor 902. As a result, the accuracy of the temperature control of the photosensitive drum 14 can be kept within a certain range, and adverse effects of the contamination of the thermopile temperature sensor 902 can be avoided.

That is, it is possible to solve a conventional problem that inadequate temperature control of the photosensitive drum causes melting/hardening of toner on the development sleeve in contact with the photosensitive drum or deterioration of the stability of images due to variations of the surface temperature of the photosensitive drum. In addition, neither a contact/separation mechanism for a contact thermistor nor a cleaning member and a driving mechanism thereof for the lens of the thermopile temperature sensor are required, so that problems concerning installation space and cost can be solved.

In the first and second embodiments described above, the case has been described by way of example where the thermopile temperature sensor having a lens to collect infrared radiation from the surface of the photosensitive drum is used as first temperature detection means. However, the present invention is not limited thereto. A thermopile temperature sensor having a filter to filter infrared radiation from the surface of the photosensitive drum may be used. In this case also, the same advantages as in the embodiments described above can be achieved.

In the first and second embodiments described above, the case has been described by way of example where the non-contact thermistor is used as second temperature detection means. However, the present invention is not limited thereto. For example, a thermistor-based non-contact temperature sensor may be used. In this case also, the same advantages as in the embodiments described above can be provided.

In the first and second embodiments, as an example, temperature control of the photosensitive drum has been described. However, the present invention is not limited thereto and can be applied to temperature control of the fixing roller (fixing member) of the fixing unit. In this case also, the same advantages as in the embodiments described above can be provided.

In the first and second embodiments, as an example of the image forming apparatus, a copier that performs electrophotographic image formation has been described. However, the present invention is not limited thereto and can be applied to a printer or facsimile machine that performs electrophotographic image formation. In this case also, the same advantages as in the embodiments described above can be provided.

It is to be understood that the object of the present invention may also be accomplished by supplying a system or an apparatus with a storage medium in which a program code of software that realizes the functions of either of the above described embodiments is stored, and causing a computer (or CPU or MPU) of the system or apparatus to read out and execute the program code stored in the storage medium.

In this case, the program code itself read from the storage medium realizes the functions of either of the above described embodiments, and hence the program code and the storage medium in which the program code is stored constitute the present invention.

Examples of the storage medium for supplying the program code include a floppy (registered trademark) disk, a hard disk, a magnetic-optical disk, a CD-ROM, a CD-R, a CD-RW, a DVD-ROM, a DVD-RAM, a DVD-RW, a DVD+RW, a magnetic tape, a nonvolatile memory card, and a ROM. Alternatively, the program code may be downloaded via a network.

Further, it is to be understood that the functions of either of the above described embodiments may be accomplished not only by executing the program code read out by a computer, but also by causing an OS (operating system) or the like which operates on the computer to perform a part or all of the actual operations based on instructions of the program code.

Further, it is to be understood that the functions of either of the above described embodiments may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

In this case, the program code may be supplied directly from a storage medium on which the program code is stored, or from a computer, database, or the like, not shown, that is connected to the Internet, a commercial network, a local area network, or the like.

The form of the program may be an object code, a program code executed by an interpreter, or script data supplied to an OS (Operating System).

The present invention is not limited to the above embodiment, and various changes and modifications can be made thereto within the spirit and scope of the present invention. Therefore, to apprise the public of the scope of the present invention, the following claims are made.

This application claims the benefit of Japanese Patent Application No. 2005-118469 filed Apr. 15, 2005, which is hereby incorporated by reference herein in its entirety.

What is claimed is:

1. An image forming apparatus comprising:

an image carrier that is rotationally driven;

a heating device that heats said image carrier;

a first temperature detection device that is disposed out of contact with a surface of said image carrier to detect temperature of said image carrier;

a second temperature detection device that is disposed out of contact with the surface of said image carrier to detect the temperature of said image carrier; and a control device that controls said heating device based on a first surface temperature detection signal for said image carrier indicating a detection result of said first temperature detection device and a second surface temperature detection signal for said image carrier indicating a detection result of said second temperature detection device, wherein said control device controls said heating device based on said first surface temperature detection signal in a case where said first surface temperature detection signal is output earlier in time than said second surface temperature detection signal, and informs of a state of said first temperature detection device in a case where said second surface temperature detection signal is output earlier in time than said first surface temperature detection signal.

2. The image forming apparatus according to claim 1, wherein, in the case where said second surface temperature detection signal is output earlier in time than said first surface temperature detection signal, said control device informs of the state of said first temperature detection device and stops heating after a lapse of a predetermined time period.

3. The image forming apparatus according to claim 1, wherein, in the case where said second surface temperature detection signal is output earlier in time than said first surface temperature detection signal, said control device informs of the state of said first temperature detection device and stops heating when a state where said second surface temperature detection signal is output earlier in time than said first surface temperature detection signal occurs a predetermined number of times.

4. The image forming apparatus according to claim 1, wherein, in the case where said second surface temperature detection signal is output earlier in time than said first surface temperature detection signal, said control device informs of the state of said first temperature detection device and performs changeover to control of said heating device based on said second surface temperature detection signal.

5. The image forming apparatus according to claim 1, wherein a detection method of said first temperature detection device is selected from a group including a detection method that detects temperature of said image carrier based on an amount of infrared radiation collected by light collecting means and a detection method that detects the temperature of said image carrier based on an amount of infrared radiation filtered by a filter.

6. The image forming apparatus according to claim 1, wherein said first temperature detection device is a thermopile temperature sensor that is disposed out of contact with said image carrier and has a thermopile element and at least one thermistor.

7. The image forming apparatus according to claim 1, wherein said second temperature detection device is selected from a group including a non-contact thermistor disposed out of contact with said image carrier and a thermistor-based non-contact temperature sensor disposed out of contact with said image carrier.

8. An image forming apparatus comprising:

an image carrier that has a heating device and is rotationally driven;

a first temperature detection device that is disposed out of contact with a surface of said image carrier to detect temperature of said image carrier;

a second temperature detection device that is disposed out of contact with the surface of said image carrier to detect the temperature of said image carrier;

a correction section that corrects a first surface temperature detection signal based on a second surface temperature detection signal for said image carrier indicating a detection result of said second temperature detection device that is obtained when said heating device is controlled to a predetermined temperature based on the first surface temperature detection signal for said image carrier indicating a detection result of said first temperature detection device; and a control device that controls said heating device based on said first surface temperature detection signal corrected by said correction section.

9. The image forming apparatus according to claim 8, wherein said correction section corrects said first surface temperature detection signal at predetermined time intervals or every a predetermined number of images formed.

10. The image forming apparatus according to claim 8, wherein a detection method of said first temperature detection device is selected from a group including a detection method that detects the temperature of said image carrier based on an amount of infrared radiation collected by light collecting means and a detection method that detects the temperature of said image carrier based on an amount of infrared radiation filtered by a filter.

11. The image forming apparatus according to claim 8, wherein said first temperature detection device is a thermopile temperature sensor that is disposed out of contact with said image carrier and has a thermopile element and at least one thermistor.

12. The image forming apparatus according to claim 8, wherein said second temperature detection device is selected from a group including a non-contact thermistor disposed out of contact with said image carrier and a thermistor-based non-contact temperature sensor disposed out of contact with said image carrier.

* * * * *